US005180331A

United States Patent [19]

Daw et al.

[11] Patent Number: 5,180,331

[45] Date of Patent: Jan. 19, 1993

[54] SUBFLOOR DAMPER AND SPILL CONTAINER

[75] Inventors: Terry L. Daw; David F. Procter, both of Salt Lake City; Kevin D. Moss, Bountiful, all of Utah

[73] Assignee: Daw Technologies, Inc., Salt Lake City, Utah

[21] Appl. No.: 473,393

[22] Filed: Feb. 1, 1990

[51] Int. Cl.[5] ..... F24F 13/10

[52] U.S. Cl. ..... 454/187; 454/290

[58] Field of Search ..... 454/187, 53, 54, 55, 454/290, 291, 348, 358, 362

[56] References Cited

U.S. PATENT DOCUMENTS

| | | | |
|---|---|---|---|
| 533,428 | 2/1895 | Beatty | 454/291 X |
| 4,729,292 | 3/1988 | Marton | 454/284 |
| 4,829,886 | 5/1989 | Battaglin | 454/289 |

FOREIGN PATENT DOCUMENTS

| | | | |
|---|---|---|---|
| 59725 | of 1891 | United Kingdom | 98/41.2 |

*Primary Examiner*—Harold Joyce

*Attorney, Agent, or Firm*—Thorpe, North & Western

[57] ABSTRACT

A device attachable to a suspended floor member (i) for collecting materials which fall through grid openings in the floor member and (ii) for controlling the rate of airflow through the grid openings in an adjustable manner. The device includes a spill container for positioning under the grid openings of the floor member in a coordinated position such that a venting path is provided for permitting airflow past the spill container from above the floor member while retaining the capacity to collect liquids and particulate matter flowing through the grid openings. Adjustable dampening structure is coupled with the spill member to provide selection of differing vent openings to control rate of airflow through the structure.

12 Claims, 2 Drawing Sheets

SUBFLOOR DAMPER AND SPILL CONTAINER

BACKGROUND OF THE INVENTION

1. Field of Invention

This invention relates to suspended flooring used in industrial and manufacturing applications wherein the floor comprises grating support above a base flooring. More specifically, the present invention relates to suspended flooring in cleanroom applications wherein the grating permits airflow through the flooring structure to maintain a cleanroom environment necessary for fabrication of micro chips and other devices requiring a dust-free environment.

2. Prior Art

Current techniques for maintain dust-free environments in clean room structures include the use of a suspended floor structure made up of modular floor gratings which permit airflow therethrough. By providing uniform airflow through the total floor structure, Eddy currents and other non-uniform flow conditions adverse to maintenance of cleanroom environment can be minimized. Airflow introduced from an overhead plenum through a HEPA filter system can be maintained in somewhat laminar flow by virtue of ventilation on a uniform basis through the flooring structure.

Adjustment of flow rate can be partially controlled by introducing dampening structure below each modular grating. Such dampening structure includes an array of slots or openings whose opening sizes are modified by sliding plates or other conventional dampening techniques. Typical dampening structure used with modular grating systems includes sheets or panels with elongated slots which are mounted to the base side of the grating floor members. A series of cover panels are mounted in slidable configuration with respect to the openings or slots. When reduced airflow is desired, the cover panels are slid over the damper openings, thereby restricting airflow. The degree of restriction is proportional to the percent reduction of damper opening size.

A major problem with utilization of dampening structure in connection with floor gratings in cleanroom applications, as well as other industrial applications, arises with collection of spilled chemicals and other material which accumulate on the damper panels and result in corrosive action. For example, inadvertent spilling of acids or other chemicals within the cleanroom result in flow through the floor grating and collection on the damper panels therebelow. If these panels are not immediately removed and cleaned, the collected acids or corrosive materials may have a destructive influence on the damper panels, not only making future adjustment of cover panels along openings more difficult, but also causing actual destruction of the panel structure.

Where cleanroom facilities are in multistory configurations, a more serious risk of injury arises to personnel working in an area under a superior cleanroom structure. In this instance, spilled chemicals may fall through floor grating and contact persons working below. Not only is there concern for injury, but productivity is affected in both levels of cleanroom operations. Some facilities mandate vacating upper cleanroom facilities where persons are working below. Obviously, such problems directly contribute to the high cost of microchip production, requiring that every measure be adopted to avoid suspension of production line activity.

Because cleanroom environments are difficult to maintain and can be compromised by lifting floor members or otherwise disturbing the structural integrity of the room, suspension of production activities for cleaning purposes is often impractical. As a consequence, corrective action with respect to spilled chemicals and corrosive materials must often be delayed until production activities are completed or other opportune cleaning times arise.

OBJECTS AND SUMMARY OF THE INVENTION

It is an object of the present invention to provide combined dampening and spill collection structure which preserves the ability to adjust flow rates of air through the flooring structure, while maintaining safe collection of all liquid and particulate matter which falls through the floor grating.

A further object of the present invention is to provide a spill container attachable below modular floor grating which includes a venting path with controlled dampening means for adjusting airflow rates.

A still further object of the present invention is to provide a combined spill container with dampening structure which can be removably attached to each respective floor grating and can be readily adjusted to develop uniform flow rate through the complete floor structure.

These and other objects are realized in a device attachable to a suspended floor member useful as a modular cleanroom floor grating for collecting materials which fall through grid openings in the grating and for controlling the rate of airflow through the grid openings in an adjustable manner. This device comprises a spill container approximately dimensioned to be positioned under the grid openings of the floor member with a collecting area of sufficient breadth and configuration to collect and retain all liquids and particulate materials passing through the grid openings into the volume of the container. Support means is provided for positioning the spill container in a coordinated position with respect to the grid openings under the floor member. This coordinated position provides a venting path (i) for permitting airflow past the spill container and (ii) for collecting and retaining all liquid and particulate material which falls through the grid openings. Adjustable control means are coupled to the spill container for regulating the rate of airflow passing through the venting path to thereby control the rate of airflow through the floor member. Various configurations can be adapted for specific purposes needed in cleanroom and other industrial applications.

Other objects and features of the present invention will be apparent to those skilled in the art in view of the following detailed description, taken in combination with the accompanying drawings.

DETAILED DESCRIPTION OF THE INVENTION

Figure 1:
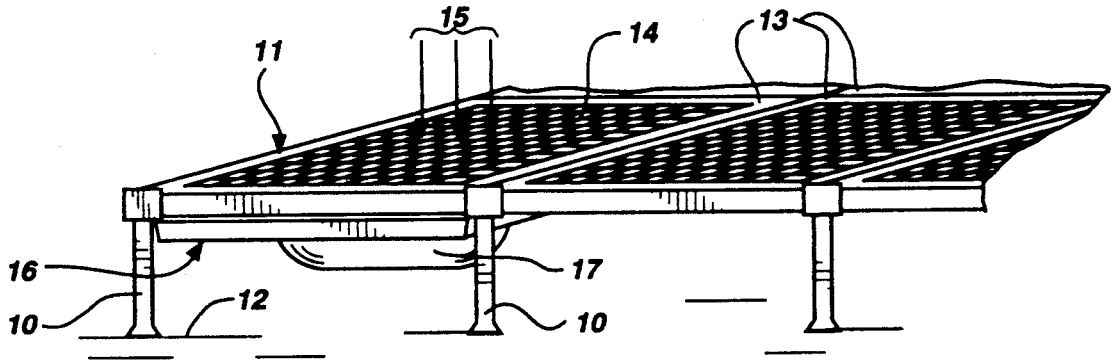
FIG. 1 shows a perspective view of a suspended floor structure having a spill container and dampening device attached thereunder.

Referring now to the drawings:

FIG. 1 illustrates a section of suspended flooring supported on mounting posts 10 which function to raise the flooring structure 11 above a base floor 12. This flooring structure 11 comprises an array of modular floor gratings 13 which are positioned in side-by-side array to form a flat floor surface. A support post 10 is positioned at the corner juncture of each of the respective contiguous floor modules 13.

The illustrated modular floor member 13 includes a grating or grid section 14 which permits spilled liquids and materials to pass through grid openings, as well as laminar airflow 15. Although this particular floor construction is particularly suited for cleanroom environments, it will be apparent to those skilled in the art that this type of suspended floor structure with grid openings is applied in other industrial applications which may likewise have utility with respect to the invention disclosed herein. Accordingly, although the preferred embodiment of the present invention is focused on applications with respect to cleanroom environments, such discussion should not be construed as limiting the applications of the present invention to only this industry.

Each modular tile 13 includes a spill container/dampening device 16 coupled to the floor member 13. This device may be of single body, injection molded construction, or may be fabricated of multiple components as is disclosed in FIG. 2. It is to be understood that the component description provided herein could likewise be realized in a unibody construction wherein the described functions are satisfied by a single structure. This structure is represented by three elements consisting of a spill container 17, support means for positioning the spill container in a desired position, and adjustable control means coupled to the spill container for regulating airflow rates.

Specifically, the spill container 17 is approximately dimensioned to be positioned under the grid openings 14 of the floor member. This container should have a collecting area 20 of sufficient breadth and configuration to collect all liquids and particulate materials passing through the grid opening into the volume of the container. Where a single construction of this device is being used, this spill container also retains all liquids and particulate materials for later disposal.

Support means 21 includes an attachment base 22 which is coupled to the underside 23 of the floor member 13. This particular coupling device 22 includes intersecting slots 24 which receive cross support structure 25. This facilitates secure attachment of this member 22 by means of screws, adhesives or other means for rigid fixation. This member 22 further includes a threaded opening 27 which is configured to receive a threaded rod 28 therein. A second rod 29 is housed within a second opening 30 for the purpose of preventing rotation of the supported structure attached to the respective rods 28 and 29. Accordingly, the support means 21 represented in FIG. 2 includes the coupling member 22 with its attached rods 28 and 29.

The function of this support means is to support an attached spill container and dampening means in a coordinated position with respect to the grid openings under the floor member. This coordinated position embodies two requirements. First, the coordinated position provides a venting path 30 represented by series of arrows 30, 31 and 32 (FIG. 3) for permitting airflow past the spill container from above the floor member. Secondly, the coordinated position provides means for collecting and retaining all liquid and particulate matter falling through the grid openings wherein such material is retained within a reservoir 34.

These two criteria for the coordinated position are established by use of an adjustable control means which incorporates the threaded rod 28 within a threaded opening 35 contained within reservoir 34. This threaded opening 35 extends all the way through the reservoir structure 34 such that a screwdriver or other tool may be inserted to provide rotational movement to the threaded rod 28. Such rotational movement develops vertical displacement 36 for reservoir 35 with respect to the floor member 13. The application of this vertical adjustment 36 to facilitate control of air flow rates will be discussed hereafter.

Figure 2:
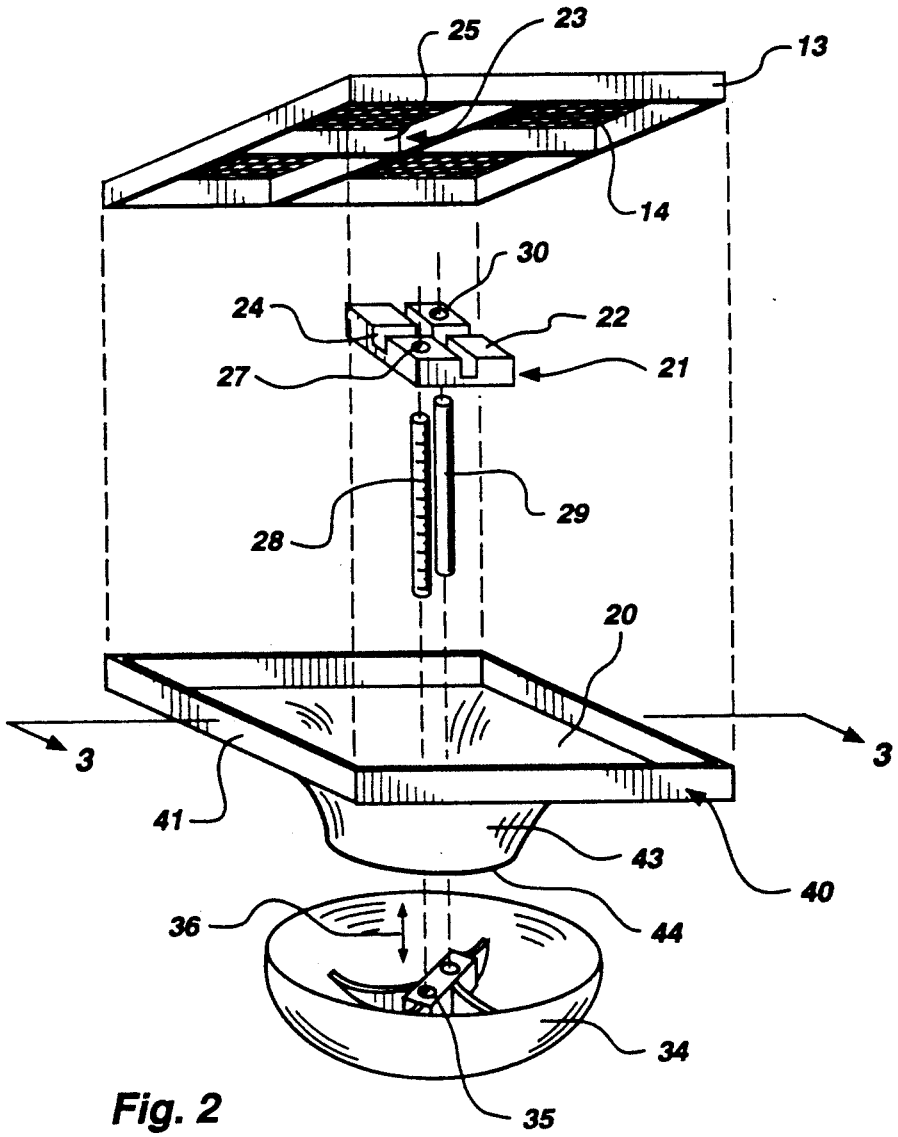
FIG. 2 illustrates an exploded, perspective view of a modular floor grating with attachable spill container and dampening components.

Turning now to the multi-component structure illustrated in FIG. 2, the spill container 17 (FIG. 1) comprises a collection member 40 and reservoir 34. The collecting member 40 includes a substantially continuous peripheral wall 41 having a configuration corresponding to a perimeter configuration of the floor member 13 and laterally enclosing the volume of the container. The collecting member 40 is approximately dimensioned to be positioned under the grid openings of the floor member 13 and is configured to collect all liquids and particulate materials which fall through the grid openings 14. The collecting member is structured with an inclined surface 20 which converges to an annular shaped member 43 having a discharge opening 44 for transfer in the collected liquid and particulate matter into the reservoir 34. This inclined surface 20 provides for natural gravity flow of these materials for collection within the reservoir 34. Because this reservoir is capable of removal without disturbing either the floor member 13 or collection member 40, clean up maintenance can be performed without disturbing cleanroom environment conditions or production operations.

A primary feature of the present invention is the combined function of airflow control by the same structure which performs the spill containment. This is accomplished by attaching the reservoir 34 by means of the support means 21 and adjustable control means, including threaded opening 35. This permits the reservoir to be movable with respect to the collecting member 40 which is attached to the floor member 13 by clips, screws or bolts (not shown). The reservoir 34 then becomes the only movable element of the structure, in combination with the threaded rod 28.

Figure 3:
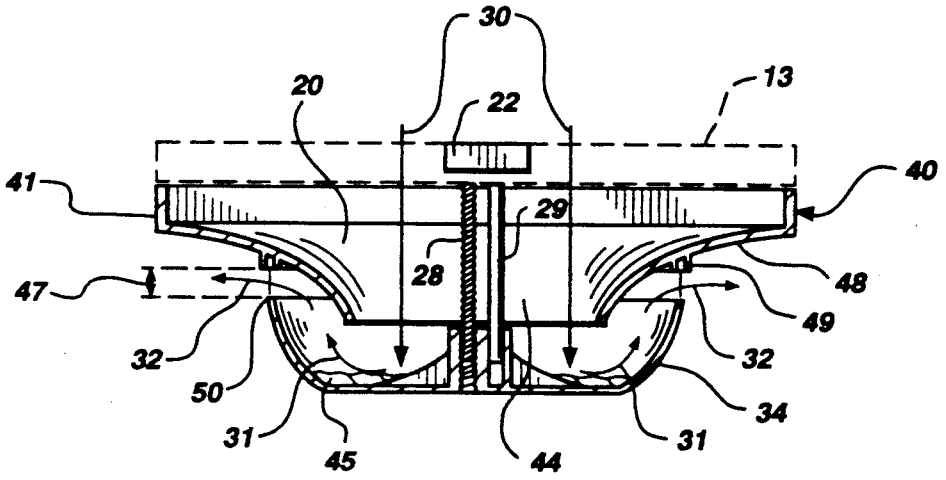
FIG. 3 is a cross section of an assembled spill container and dampening structure taken along the lines 3—3 of FIG. 2.

The reservoir is located in its coordinated position which is illustrated in FIG. 3. This position provides the referenced venting path 30, 31 and 32. Specifically, air flows through the grating of the floor member 13 (phantom line) and through the discharge opening 44. Airflow then passes above any retained liquids or material 45 and through a displacement gap as illustrated by arrows 31 and 32. The rate of airflow through this gap is controlled by the most restricted spacial separation represented by the phantom lines and distance arrow 47. This spacial separation 47 is adjusted or modified by rotation of the threaded rod 28, which raises or lowers the reservoir 34 with respect to the lower surface 48 of the collecting member. This lower surface 48 may include an annular receiving channel 49 configured in size to receive the upper rim 50 of the reservoir 34. This combination develops the upper extreme position of substantial sealed contact between the rim 50 of the reservoir 34 and the channel 49. Rod 29 is provided to prevent rotation of the reservoir while the threaded rod 28 is being turned. Accordingly, rod 29 acts as a stabilizing guide to maintain proper orientation of the reservoir with respect to the collecting member. To insure full collection of all liquids and particulate materials, the reservoir should have a collecting area greater in size than the discharge opening 44 of the collecting member.

Figure 4:
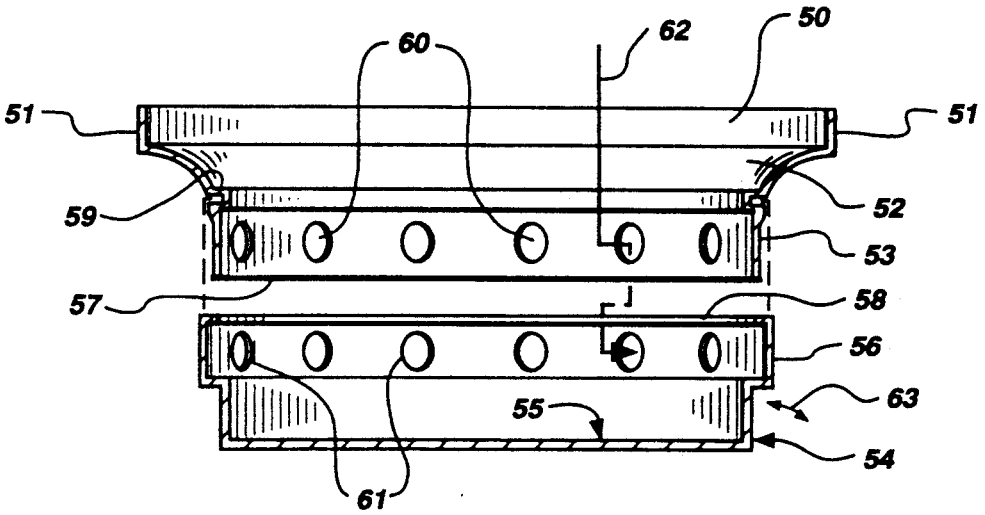
FIG. 4 shows a modified version of a combined dampening means and spill container shown along the same cross section as illustrated in FIG. 3.

It will be apparent to those skilled in the art that many methods and structures can be applied to dampen flow rate in addition to the vertical displacement mechanism shown in FIGS. 2 and 3. For example, FIG. 4 shows an alternate embodiment wherein a collector member 50 is illustrated in cross section with side walls 51 adapted for attachment to the lateral edges of the floor member. This collecting member 50 includes an inclined collecting surface 52 which converges to a discharge opening defined within downward projecting side walls 53. A reservoir 54 includes a receiving section 55 with upward extending walls 56. These receiving walls 56 are dimensioned and configured to slidably fit in a telescopic manner around the side walls 53 of the discharge opening 57. Accordingly, the reservoir 54 is mounted on the downward projecting side walls 53 of the collector member such that the respective side walls 53 and 56 are in telescopic, slidable relationship. This relationship is retained by virtue of an upper lip 58 formed as a radial flange on the reservoir, and a corresponding annular track 59 which receives the lip 58 and retains the reservoir in its attached position to the collector member.

The required venting path is formed by a plurality of openings 60 and 61 which extend around the respective side walls 53 and 56. These respective openings 60 and 61 are of common size and are equally spaced to permit full alignment for maximum air flow as is illustrated by flow line 62. Dampening of this airflow is accomplished by rotating 63 the reservoir to offset the reservoir opening 61 with respect to the openings 60 of the collector member. The degree of dampening affect will correspond to the degree of reduction in opening area.

Figure 5:
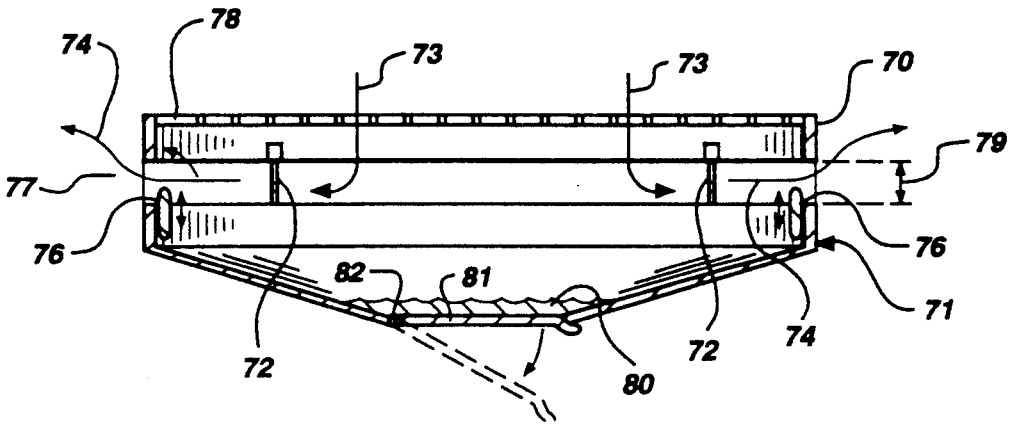
FIG. 5 shows a cross section of an additional embodiment of the present invention having a unibody construction.

An example of a unibody construction for the present invention is shown in FIG. 5. In this configuration, the floor member 70 has an attached spill container 71 which is retained in the attached position by mounting clips 72. These mounting clips maintain the attached spill container 71 in fixed position with respect to the floor member, with both requirements of the coordinated position being satisfied. Specifically, the spill container is oriented for collecting and retaining all liquid and particulate matter which falls through grid openings of the floor member. Secondly, a venting path is provided 73, 74 for permitting airflow past the spill container from above the floor member. Damping control is provided by slidable plates 76 which are positioned in tracks along each side of the spill container. These damping plates 76 can be raised or lowered to effectively reduce the amount of gap between the floor member and the spill container. Vertical positioning of the respective damper plates 76 can be controlled by worm gears mounted with respect to each plate and accessed through a grip opening 78 in the floor member.

In a similar manner, vertical lifting devices could be coupled to the spill container 71, in which case the dampening plate 76 could be deleted and the full spill container structure could be raised or lowered to effectively reduce the venting path by reducing the separation distance 79 between the floor member 70 and spill container 71. In this embodiment, stationary clips identified as item 72 in FIG. 5 would be substituted with worm gear lifters which could effectively position the spill container 71 at a variety of positions relative to the floor member, thereby changing the side of the venting path based on the separation distance between the respective walls of the floor member and spill container. Releasing entrained liquids and materials 80 is accomplished by adapting a release door 81 at a base portion of the spill container, with a hinged access 82 to release this door to remove collected debris and materials.

It will be apparent to those skilled in the art from the foregoing description of embodiments that numerous structures can be adopted to implement the inventive concepts disclosed herein. Accordingly, it is to be understood that the foregoing description is by way of example and is not to be construed as limiting with respect to the following claims.

We claim:

1. A device attachable to a suspended floor member (i) for collecting materials which fall through grid openings in the floor member and (ii) for controlling the rate of air-flow through the grid openings in an adjustable manner, said device comprising:

1.1 a spill container approximately dimensioned to be positioned under the grid openings of the floor member with a collecting area of sufficient breadth and configuration to collect and retain all liquids and particulate materials passing through the grid openings into the volume of the container;

1.2 support means for positioning the spill container in a coordinated position with respect to the grid openings under the floor member, said coordinated position providing (i) a venting path for permitting air flow past the spill container from above the floor member, and (ii) means for collecting and retaining all liquid and particulate matter falling through the grid openings; and 1.3 adjustable control means coupled to the spill container for regulating the rate of air flow passing through the venting path to thereby control the rate of air flow through the floor member.

2. A device as defined in claim 1, wherein the spill container includes a substantially continuous peripheral wall having a configuration corresponding to a perimeter configuration for the floor member and laterally enclosing the volume of the container, said support means providing a coordinated position wherein the peripheral wall of the container is substantially aligned with and displaced from the perimeter of the flooring member to form an opening therebetween defining the venting path, said adjustable control means providing for adjustment of size of the opening to selectively control flow rate therethrough.

3. A device as defined in claim 2, wherein the adjustable control means is coupled to the peripheral wall of the spill container and provides means for reducing the opening size of the venting path.

4. A device as defined in claim 2, wherein the control means comprises a dampening plate capable of continuous adjustment between (i) an open position wherein the venting path is unobstructed and (ii) a closed position wherein the venting path is substantially closed.

5. A device as defined in claim 2, wherein the control means comprises vertical displacement means coupled to the spill container and operable to change the opening size of the venting path by moving the peripheral walls of the spill container vertically with respect to the perimeter of the flooring member.

6. A device as defined in claim 1, wherein the adjustable control means comprises vertical displacement means coupled between the flooring member and the spill container and operable to permit selective positioning of the spill container at a variety of positions of relative greater displacement with respect to the floor member, thereby changing the size of the venting path to control the rate of air flow.

7. A device as defined in claim 6, wherein the vertical displacement means comprises a threaded rod rotatably journaled within a threaded opening in either the flooring member or spill container such that rotation of the rod causes relative vertical displacement of the spill container with respect to the floor member and concurrent adjustment of the opening size of the venting path.

8. A device as defined in claim 1, wherein the spill container comprises two components including a collection member and a reservoir, said collecting member being approximately dimensioned to be positioned under the grid openings of the floor member and having a collecting area of sufficient breadth and configuration to collect all liquids and particulate materials passing through the grid openings;

said collecting area being structured with an inclined surface and discharge opening for causing gravity flow of collected materials toward the discharge opening;

said reservoir being movably coupled with respect to the collecting member at a coordinated position providing (i) a venting path for permitting air flow between the collecting member and reservoir from above the floor member, and (ii) proper alignment below the discharge opening for collecting and retaining all liquid and particulate matter falling through the discharge opening;

said reservoir having a collecting area greater in size than the discharge opening to thereby receive and retain all liquids and particulate matter passing therethrough;

said adjustable control means being coupled to the reservoir to enable modification of the venting path to enhance or reduce air flow rate therethrough.

9. A device as defined in claim 8, wherein the reservoir comprises a containar with upward extending side walls and an upper rim, said control means being operable to vertically displace the upper rim of the reservoir container toward or away from a bottom side of the collector member to thereby define the venting path and provide adjustability to the size of the path opening.

10. A device as defined in claim 9, wherein the adjustment control means comprises a threaded rod rotatably journaled within a threaded opening in either the flooring member or reservoir such that rotation of the rod causes relative vertical displacement of the reservoir with respect to the bottom side of the collector member and concurrent adjustment of the opening size of the venting path.

11. A device as defined in claim 10, wherein the upper rim of the reservoir lies within a single plane, said bottom side of the collector member having an annular receiving channel configured in size to receive the rim of the reservoir, thereby enabling the reservoir to be adjusted to an elevated position seated within the receiving channel.

12. A device as defined in claim 9, wherein the collector member includes downward projecting sidewalls defining the discharge opening, said reservoir side wall being dimensioned and configured to slidably fit around the sidewalls of the discharge opening in telescopic manner;

said venting path being formed by a plurality of openings extending through the respective walls of the discharge opening and reservoir in aligned manner, thereby enabling adjustment of the venting path by misaligning the openings to thereby reduce effective opening size.

* * * * *